US007931672B2

(12) United States Patent
Tesini et al.

(10) Patent No.: US 7,931,672 B2
(45) Date of Patent: Apr. 26, 2011

(54) ORTHODONTIC PACIFIER/NIPPLE APPLIANCE

(76) Inventors: David A. Tesini, Hopkinton, MA (US); Joshua Wiesman, Wayland, MA (US)

( * ) Notice: Subject to any disclaimer, the term of this patent is extended or adjusted under 35 U.S.C. 154(b) by 282 days.

(21) Appl. No.: 11/762,933

(22) Filed: Jun. 14, 2007

(65) Prior Publication Data

US 2007/0238063 A1 Oct. 11, 2007

Related U.S. Application Data

(63) Continuation-in-part of application No. 11/459,962, filed on Jul. 26, 2006, now Pat. No. 7,731,733, and a continuation-in-part of application No. 11/755,050, filed on May 30, 2007.

(60) Provisional application No. 60/702,478, filed on Jul. 26, 2005.

(51) Int. Cl.
*A61J 17/00* (2006.01)

(52) U.S. Cl. ..... 606/236

(58) Field of Classification Search ..... 433/2, 6; 606/234, 235, 236
See application file for complete search history.

(56) References Cited

U.S. PATENT DOCUMENTS

| | | | | |
|---|---|---|---|---|
| 2,520,773 | A | 8/1950 | Muller | |
| 4,481,949 | A | 11/1984 | Kesselring et al. | |
| 5,123,915 | A * | 6/1992 | Miller et al. | 606/234 |
| 5,133,740 | A | 7/1992 | Kussick | |
| 5,275,619 | A * | 1/1994 | Engebretson et al. | 606/236 |
| 5,570,796 | A | 11/1996 | Brown et al. | |
| 5,606,871 | A * | 3/1997 | Hansen et al. | 62/457.5 |
| 5,772,685 | A | 6/1998 | Crowe et al. | |
| 5,779,071 | A | 7/1998 | Brown et al. | |
| 5,922,010 | A | 7/1999 | Alanen et al. | |
| 6,253,935 | B1 | 7/2001 | Fletcher | |
| 6,446,822 | B1 | 9/2002 | Meyers et al. | |
| 6,601,720 | B2 | 8/2003 | Meyers et al. | |
| 6,699,264 | B1 * | 3/2004 | Rohrig | 606/234 |
| 7,029,491 | B2 | 4/2006 | Davis | |
| 2003/0034031 | A1 | 2/2003 | Lev et al. | |

FOREIGN PATENT DOCUMENTS

| | | |
|---|---|---|
| FR | 2302724 | 1/1976 |

* cited by examiner

*Primary Examiner* — Ralph A Lewis
(74) *Attorney, Agent, or Firm* — Brian M. Dingman; Mirick, O'Connell, DeMallie & Lougee, LLP

(57) ABSTRACT

Intraoral orthodontic pacifier/nipple appliances having integrated orthodontic functionality. The appliance has an integrated orthodontic mechanism. The bulb expands or moves upward and expands outward as a child sucks on it, to counteract inward pressure of the cheeks and the lateral portion of the lips caused by suction or sucking action. The invention also provides products including the orthodontic appliance, as well as methods of using the appliance and products including the appliance in the inhibition and treatment of certain malocclusions in the primary dentition of young children.

35 Claims, 24 Drawing Sheets

ORTHODONTIC PACIFIER/NIPPLE APPLIANCE

CROSS-REFERENCE TO RELATED APPLICATIONS

This application is a continuation in part and claims priority of application Ser. No. 11/459,962, entitled "Expanding Orthopedic Pacifier", filed on Jul. 26, 2006 now U.S. Pat. No. 7,731,733, which itself claims priority of Provisional application Ser. No. 60/702,478 filed on Jul. 26, 2005. The disclosures of both prior applications are incorporated herein by reference. This application is also a continuation in part and claims priority of application Ser. No. 11/755,050, entitled "Expanding Nipple Appliance", filed on May 30, 2007, the disclosure of which is incorporated herein by reference.

BACKGROUND OF THE INVENTION

1. Field of the Invention

The present invention relates to an orthodontic pacifier/nipple appliance, in particular a pacifier/nipple appliance comprising an integrated orthodontic mechanism.

2. Background of the Invention

Continuous or persisting non-nutritive sucking of, e.g., a finger, thumb, and/or pacifier, produces risks of posterior crossbites, anterior open bites, increase overjet and Class II canine and molar relationships. See, e.g., Douglass, C. (ed). *Oral Care Report* 15(2): 4 (2005); and Ogaard, B., Larsson, E., and Lindsten, R., *Am. J. Orthod. Dentofac. Orthop.* 106: 161-166 (1994). Posterior crossbite in the primary dentition is one of the most common consequences of non-nutritive sucking of pacifiers. Studies have demonstrated that between about six and twenty percent of children with non-nutritive sucking habits develop posterior crossbites; and this frequency increases to approximately thirteen percent (13%) in children who use a pacifier up to 24-36 months of age. See, e.g., Warren, J. J., et al., *Am. J. Ortho Dentofacial Orthip.* 121: 347-356 (2002); and Warren, J. J., et al., *JADA* 132: 1685-1693 (2001). Crossbite is a transverse maxillo-mandibular discrepancy caused by maxillary arch constriction. Maxillary arch constriction can be precipitated by resulting inward pressure of the cheeks and the lateral portion of the lips which occurs from lowering the tongue and constriction of the cheek and lip muscles as a child sucks on a digit or pacifier bulb.

Recent policy of the American Academy of Pediatrics (AAP) recommends use of a pacifier through at least 12 months of age, and encourages infants be put to sleep with a pacifier to reduce the incidence of Sudden Infant Death Syndrome (SIDS). See, American Academy of Pediatrics (AAP) Policy: *Pediatrics* 116(5): 1245-1255 (2005). Pacifiers are also commonly used by older children, and the recent American Academy of Pediatrics (AAP) recommendation is likely to persist beyond the one-year recommendation. With this recent guidance by the American Academy of Pediatrics (AAP), the incidence of pacifier use, as well as resulting orthodontic complications is also expected to increase. Although pacifier use has certain health benefits, duration of use has an exponential effect on the development of malocclusions. Correcting and/or preventing malocclusions at an early age will prevent future orofacial disharmonies complicated by aberrant oro-myofunction. It would thus be useful to inhibit or prevent maxillary arch constriction resulting, at least in part, from pacifier usage.

SUMMARY OF THE INVENTION

The present invention is an orthodontic pacifier/nipple appliance. The appliance is adapted to provide an integrated orthodontic means into a pacifier, nipple, bottle, or similar intraoral appliance such as a soother or teether, for example. The invention also provides products comprising the orthodontic appliance, as well as methods of using the appliance and products comprising the appliance in the prevention and treatment of malocclusions in the primary dentition of young children.

The invention features an intraoral orthodontic appliance, comprising a base portion, a bulb portion having an integrated orthodontic means for expanding as the child sucks on the bulb, and a neck portion connecting the base portion and bulb portion. A sucking force by a child activates the orthodontic means by compression of a front of the bulb portion to redirect force outward and upward by expansion of lateral walls of the bulb, thereby conveying pressure against the palate, alveolar ridge, and/or the teeth. The bulb portion has a familiar shape, appearance and feel. The integrated orthodontic means can be wholly integrated into the bulb material, or substantially integrated into the bulb material. The redirection of force can be by expansion of lateral walls of the bulb.

The integrated orthodontic means may comprise alteration of curvature of one or more walls of the bulb as compared to traditional bulb design, and/or alteration of thickness of one or more regions of the bulb walls as compared to traditional bulb design, and/or a multiflow construction of the bulb wherein one or more regions of the bulb walls are constructed of at least one different durometer material as compared to another region of the bulb walls, and/or integration of ribbing on the inside of one or more regions of a wall of the bulb. The ribbing may comprise texture integrated into the upper wall of the bulb.

The bulb may have a traditional shape, or be oblate shaped or cherry shaped. The appliance may further comprise a shield, and optionally may include a handle. The appliance may be adapted for use as a teething device. The bulb may be filled with a liquid or gel. The appliance can be cooled or frozen before use. The appliance can be adapted for use as a pacifier, or as a feeding nipple, for example, in which case it may have an open channel for passage of liquid, or a valve or hole to allow passage of a liquid.

The invention also features a baby product comprising the appliance as described above, wherein the product is selected from a bottle nipple, a bottle, a pacifier, a teething device or soother, and a feeding device. The appliance may further comprise one or more external adaptations selected from the group consisting of an anti-tongue coating neck, an anti-pout lip neck, and external teething texture.

The invention also features a method of inhibiting or ameliorating certain malocclusion in the primary dentition of a young child, the method comprising administering to a child in need thereof a product comprising an intraoral orthodontic appliance, comprising a base portion, a bulb portion having an integrated orthodontic means for expanding as the child sucks on the bulb, and a neck portion connecting the base portion and bulb portion, wherein a sucking force by a child activates the orthodontic means by compression of a front of the bulb to redirect force outward and upward by expansion of lateral walls of the bulb, thereby conveying pressure against the palate, alveolar ridge, and/or the teeth, and wherein the bulb portion has a familiar shape, appearance and feel, and wherein administering the product results in inhibiting or ameliorating certain malocclusion in the primary dentition of the child.

BRIEF DESCRIPTION OF THE DRAWINGS

Objects, features and advantages will occur to those skilled in the art from the following detailed description of certain preferred embodiments and the accompanying drawings in which:

FIGS. 3G-2M are side, top, base end, bottom, bulb end, top perspective and bottom perspective views, respectively, of this same size 1 embodiment;

FIGS. 9A and 9B are side and cross-sectional views, respectively, of another embodiment of the invention with a "bellows" type integral expansion mechanism, while

DESCRIPTION OF CERTAIN PREFERRED EMBODIMENTS OF THE INVENTION

Figure 1C:
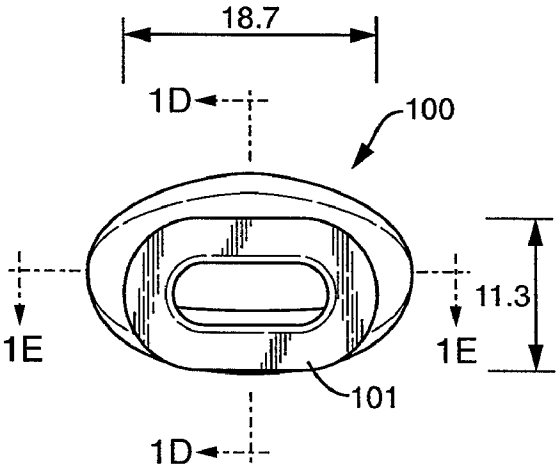
FIGS. 1A-1G are side, top, end, vertical cross-sectional, two horizontal cross-sectional and an enlarged partial cross-sectional view, respectively, of a first embodiment of the invention comprising an orthodontic pacifier/nipple appliance of the invention, wherein the proportions are adapted to a size 3 to accommodate a child about 12 months in age to about 18 months.
Figure 1B:
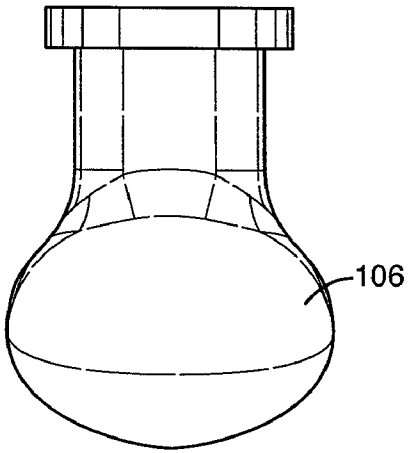
Figure 1A:
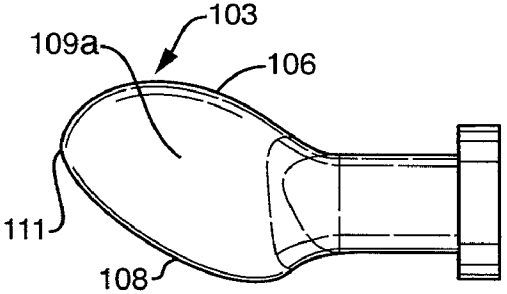
Figure 1E:
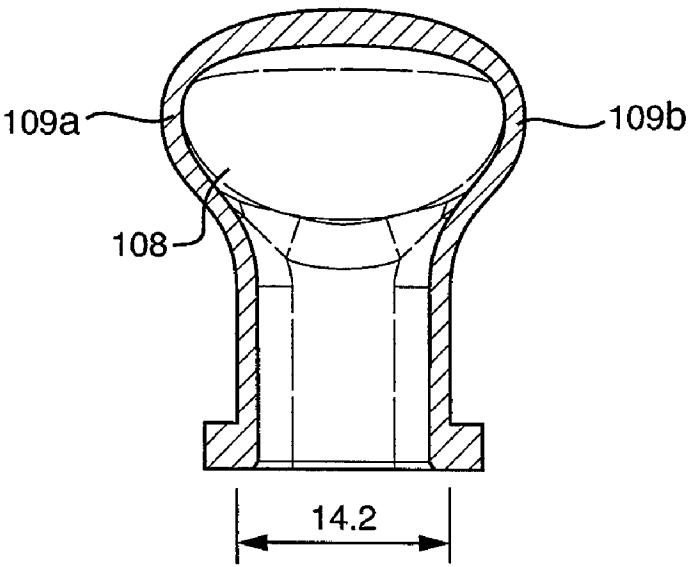
Figure 1D:
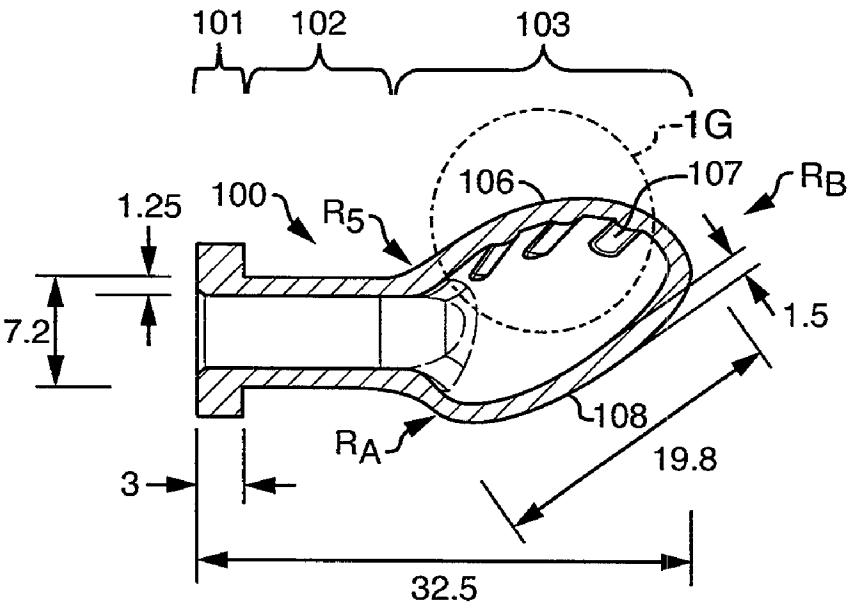
Figure 1G:
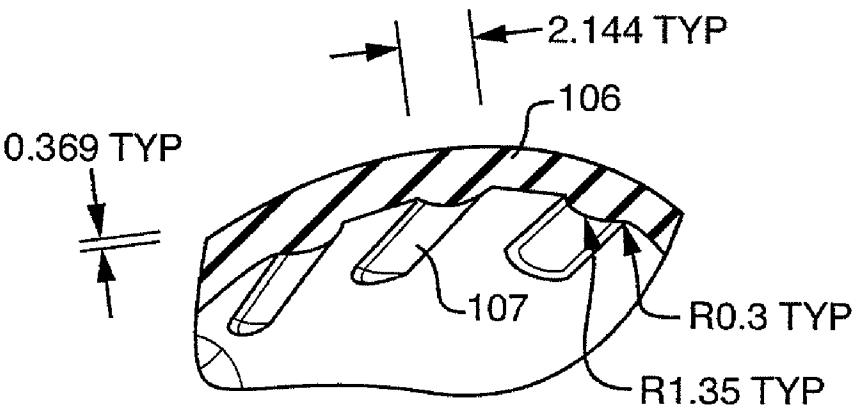
Figure 1F:
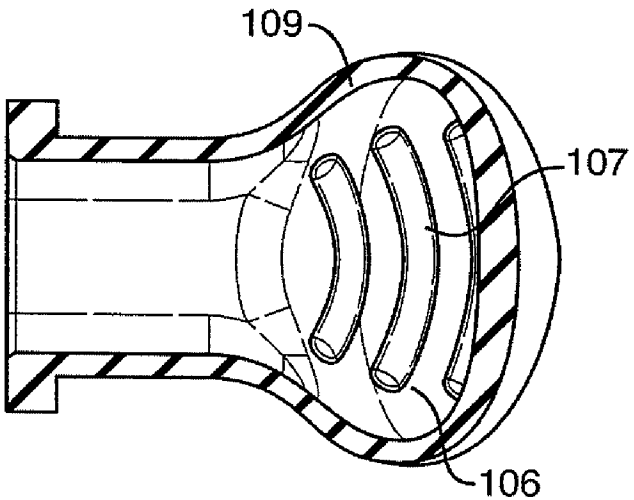
Figure 1J:
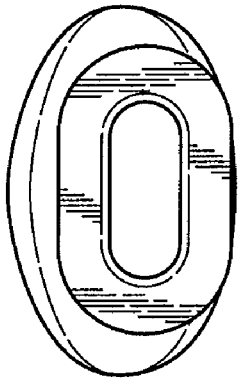
FIGS. 1H-1N are side, top, base end, bottom, bulb end, top perspective and bottom perspective views, respectively, of this same size 3 embodiment.
Figure 1I:
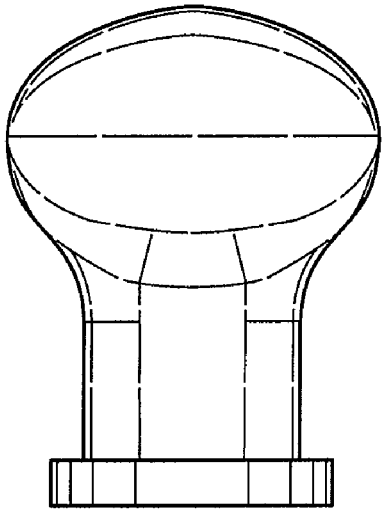
Figure 1H:
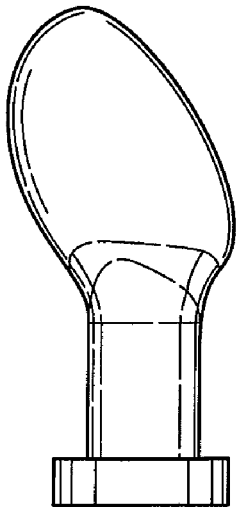
Figure 1L:
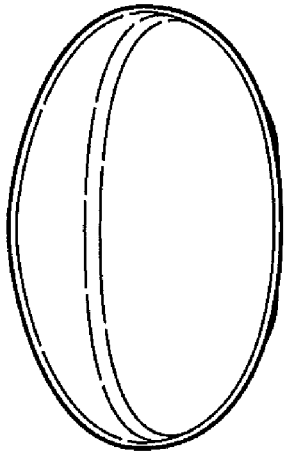
Figure 1K:
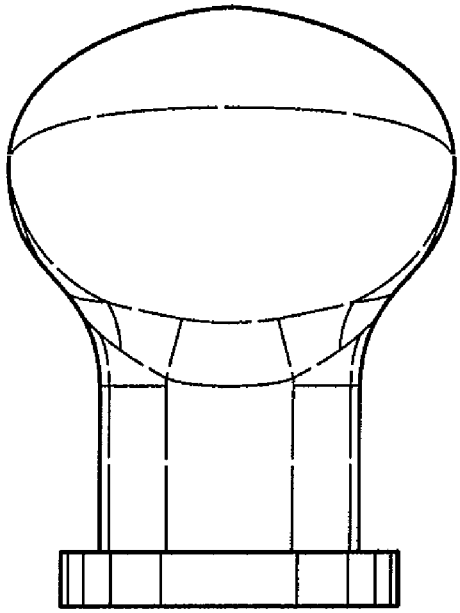
Figure 1N:
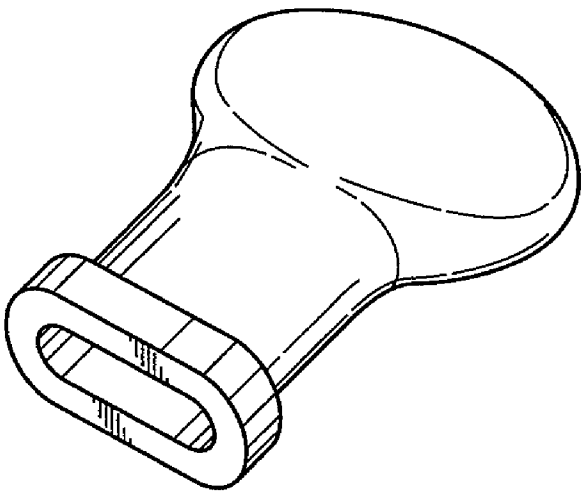
Figure 1M:
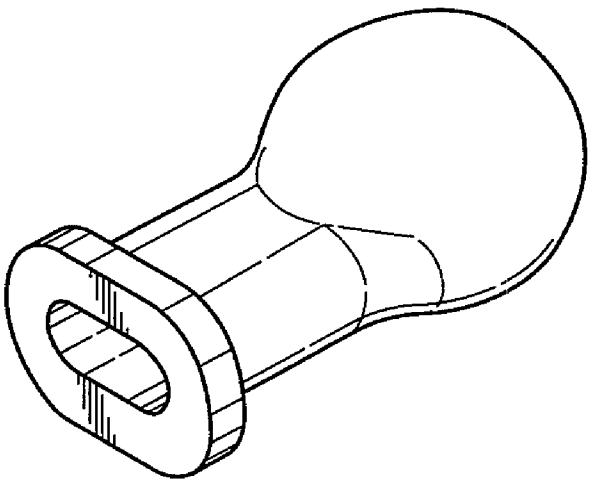
Figure 2C:
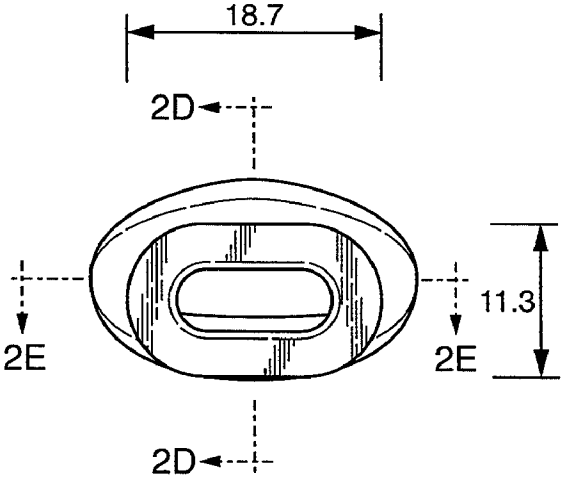
FIGS. 2A-2F are side, top, end, vertical cross-sectional, horizontal cross-sectional and an enlarged partial cross-sectional view, respectively, of a smaller size of the first embodiment of the invention wherein the proportions are adapted to a size 2 to accommodate a child about six months in age to about 12 months.
Figure 2B:
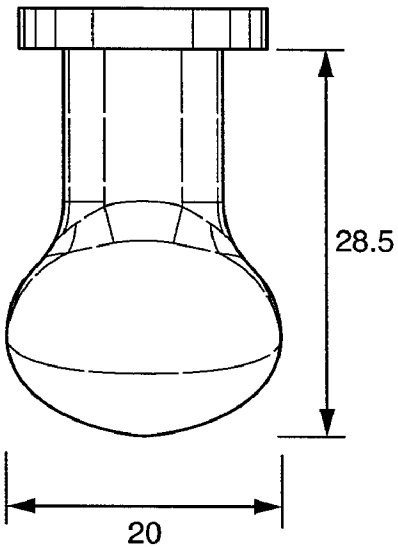
Figure 2A:
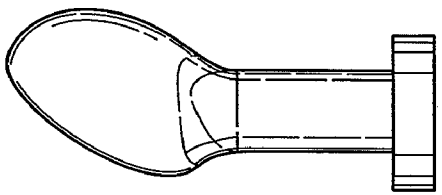
Figure 2E:
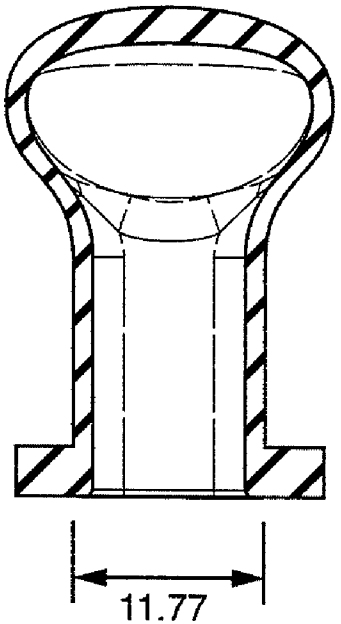
Figure 2D:
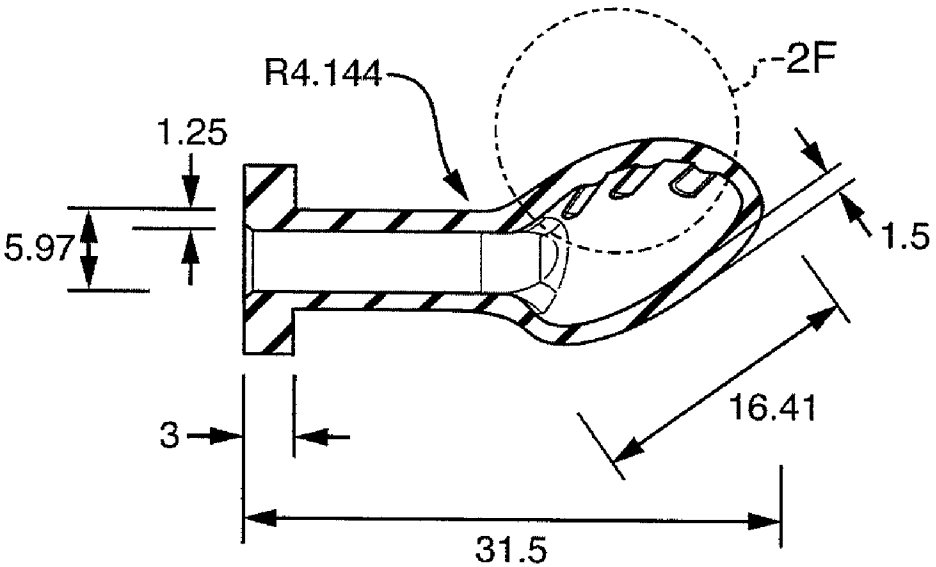
Figure 2G:
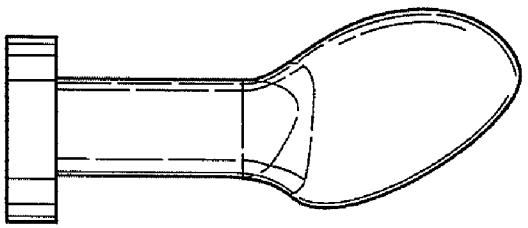
FIGS. 2G-2M are side, top, base end, bottom, bulb end, top perspective and bottom perspective views, respectively, of this same size 2 embodiment.
Figure 2F:
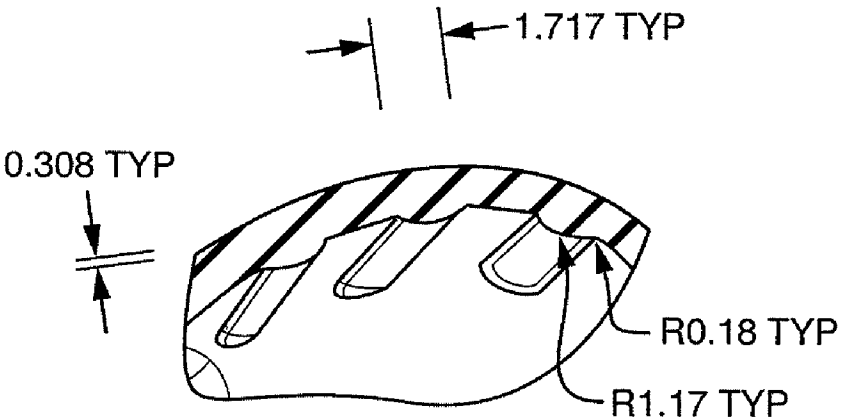
Figure 2I:
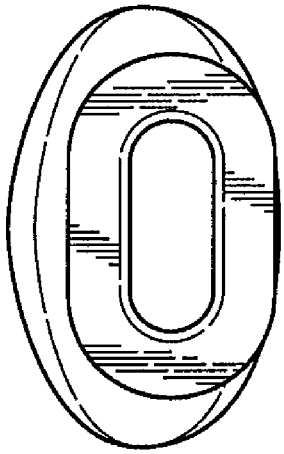
Figure 2H:
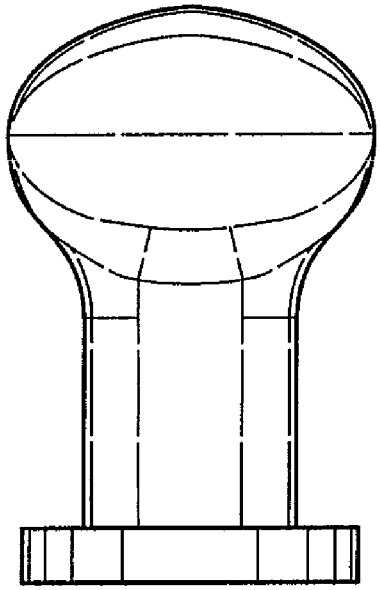
Figure 2K:
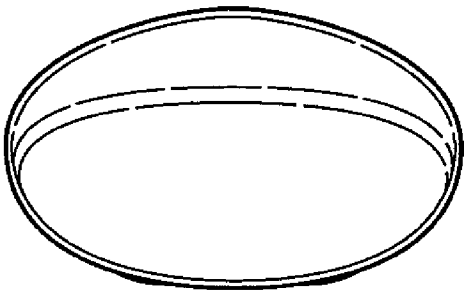
Figure 2J:
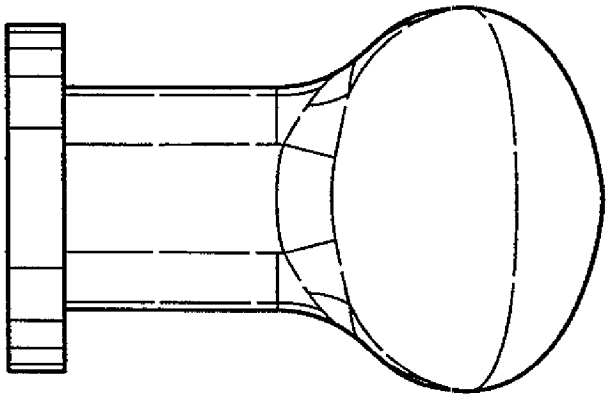
Figure 2M:
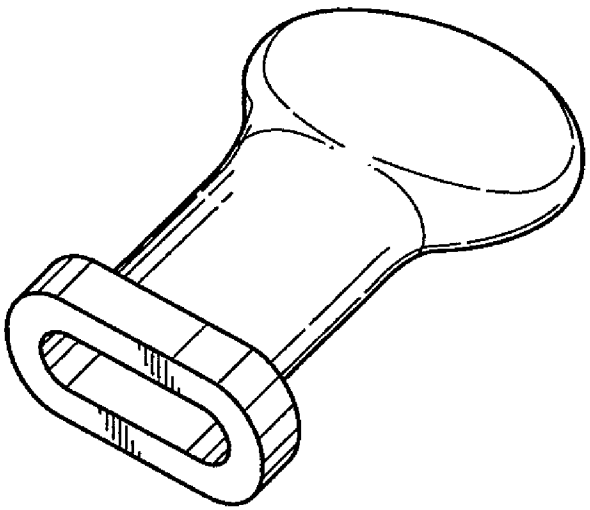
Figure 2L:
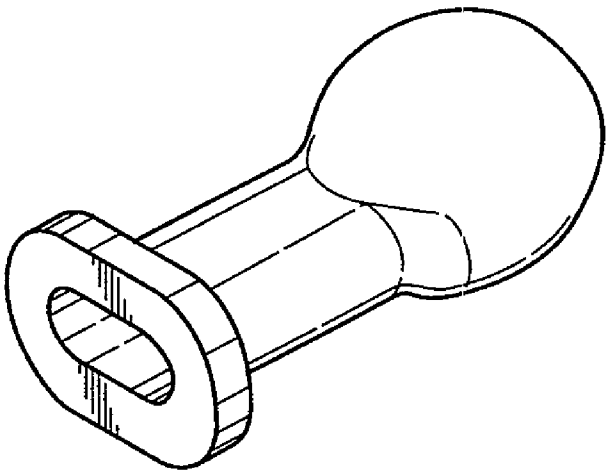
Figure 3C:
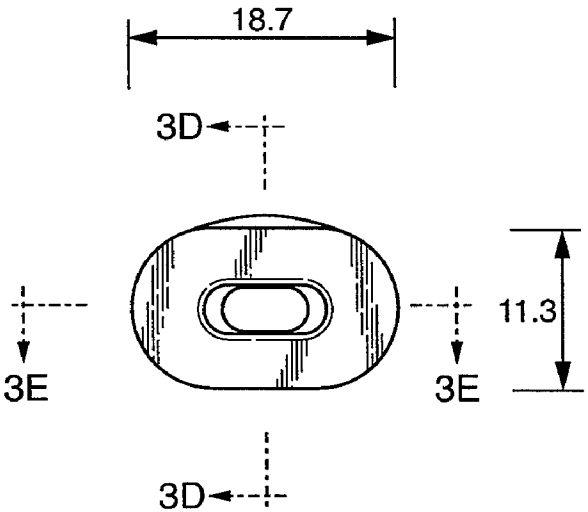
FIGS. 3A-3F are side, top, end, vertical cross-sectional, horizontal cross-sectional and an enlarged partial cross-sectional view, respectively, of a yet smaller size of the first embodiment of the invention wherein the proportions are adapted to a size 1 to accommodate an infant from birth to about age 6 months.
Figure 3B:
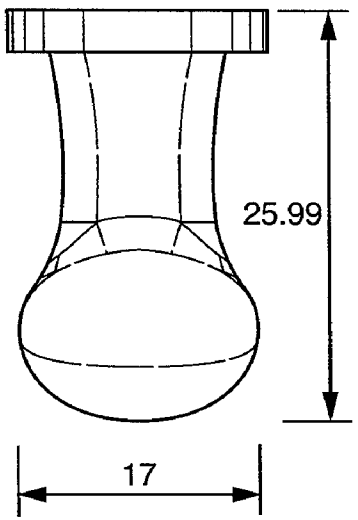
Figure 3A:
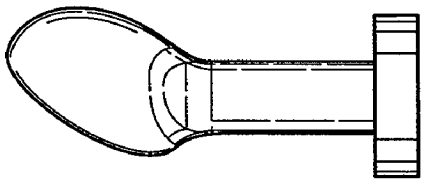
Figure 3E:
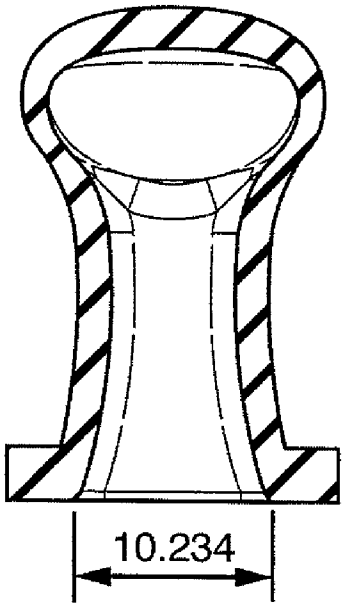
Figure 3D:
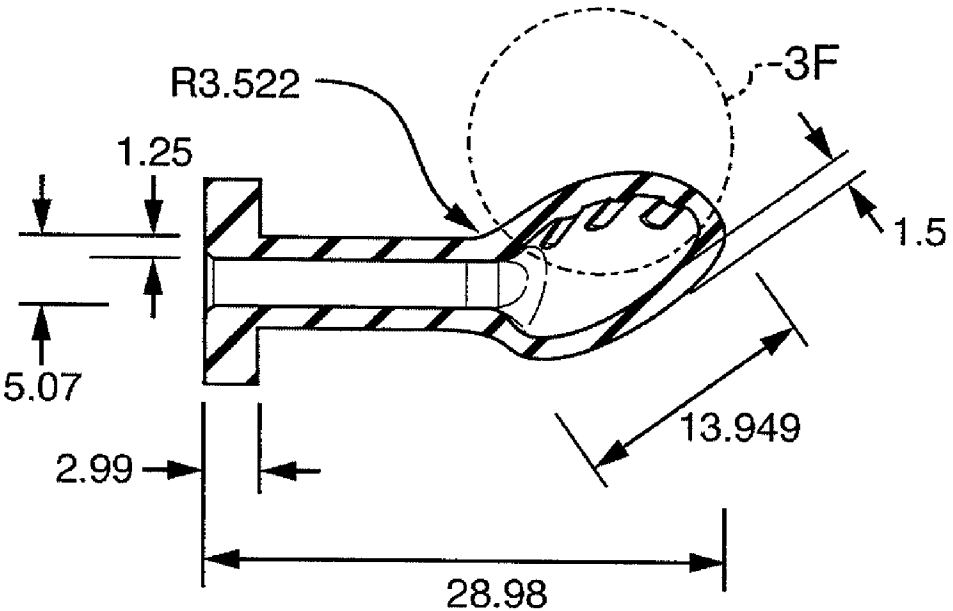
Figure 3G:
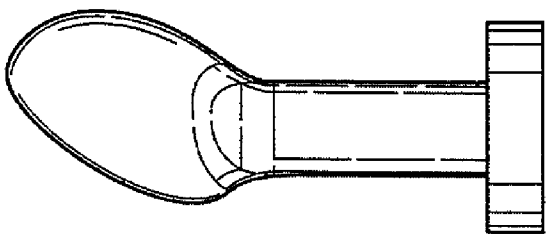
Figure 3F:
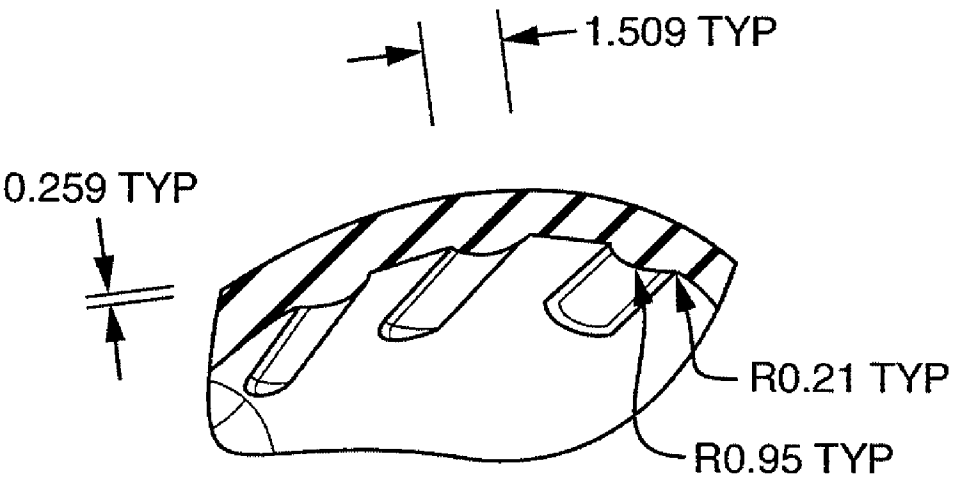
Figure 3J:
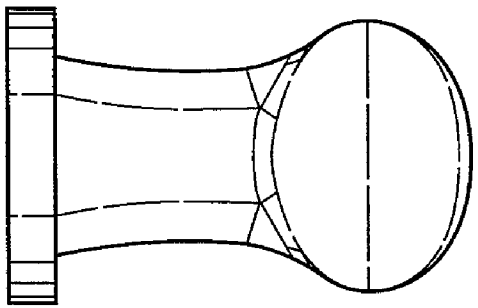
Figure 3I:
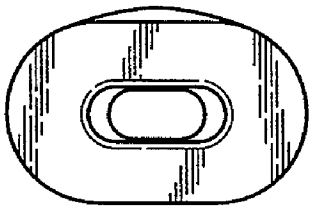
Figure 3H:
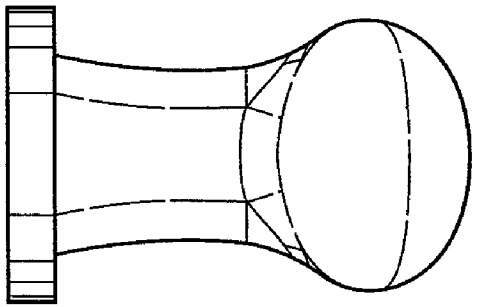
Figure 3M:
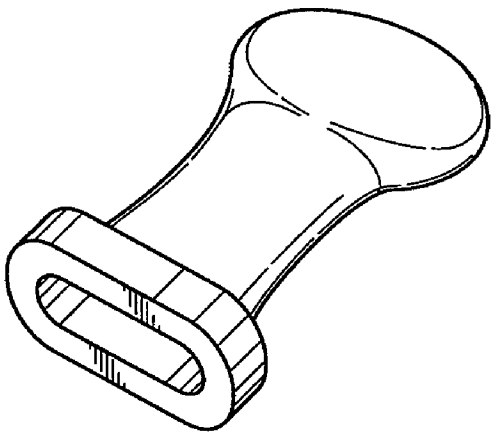
Figure 3L:
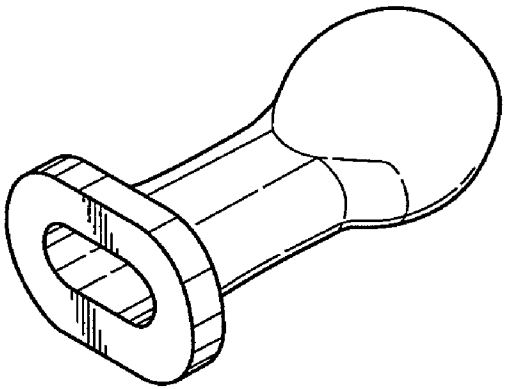
Figure 3K:
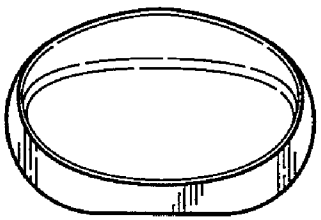

The present invention features an orthodontic pacifier/nipple appliance. The bulb portion of the appliance expands in designated areas as a result of activation of a unique design and mechanism, resulting in lateral pressure against the palate of the individual. Resulting lateral pressure works to prevent maxillary arch constriction caused by the inward pressure of the cheeks and the lateral portion of the lips that normally occurs when a child sucks on a traditional nipple of a bottle or a pacifier bulb. The appliances of the invention maintain oro-muscular balance of constricting inward forces and expanding outward forces on the maxillary palate.

Without an object (e.g., pacifier, nipple, thumb, finger, etc.) in the mouth, the tongue naturally exerts a positive pressure in the mouth against the alveolar ridges and teeth. This positive pressure promotes inter-canine and inter molar distance growth of the teeth as well as expansion of the width of the alveolar ridges. However, when a child sucks on an object (e.g., the bulb of a pacifier or nipple, or a thumb or finger, etc.), the tongue is compressed and the object exerts pressure against the palate, causing a negative pressure toward the midline of the roof of the mouth, affecting the teeth and alveolar ridge, particularly in the upper deciduous canines and molars. The negative pressure has an adverse effect on the growth distance of the upper jaw as well as the alveolar ridge, resulting in prevention of natural growth outward, and jaw expansion, resulting in crossbite and a narrow upper jaw.

Bulb expansion is accomplished in the inventive appliance via means that cause expansion due to suction itself and/or the movement of the tongue during sucking action. Several possible means are provided. In one embodiment, expansion is a result of the presence of ribbing integrated into the inside of the bulb of the pacifier/nipple that directs or redirects tongue and mouth forces to one or more proper locations. In another embodiment, expansion is a result of the presence of adaptations of one or more wall shape(s) and/or wall thickness(es) in particular areas of bulbs. Adaptations redirect forces to expand the bulb in a lateral direction when a child sucks on the appliance. Forces are redirected to the outer walls of the bulb against the inside of the palate of the mouth, thus counteracting the inward forces resulting from sucking. In some embodiments, one or more of size, shape, construction and/or thickness of the bulb are combined with ribbing to redirect sucking forces on the nipple to effect the means. Compression of the bulb and the resulting compression of the fluid inside the bulb (typically, air) can also contribute to expansion.

As used herein, the term "ribbing" is any additional textured feature integrated, whether in whole or in part, into the bulb wall of the pacifier or nipple, and may be present in any of various shapes, configurations, patterns, and/or thicknesses. When present, ribbing changes the flex and movement of the bulb under load. In some embodiments, one or more aspects of ribbing (e.g., shape, configuration, pattern, thickness, etc.) may be modified while including ribbing present in the bulb. Ribbing may have material characteristics that differ from the main bulb, due to variation in shape, configuration, pattern, thickness, or material used. Additionally, one or more aspects of ribbing may be altered throughout a single region having ribbing integrated into the bulb wall.

Three different sizes of an embodiment of the invention are depicted in FIGS. 1-3, respectively. Pacifier/nipple 100 has a bulb portion 103 and neck portion 102 that are located in the mouth of the individual, and a base portion 101 that is located outside the mouth. A typical pacifier of this shape has wall thicknesses of about 1.25 mm, and lower bulb wall 108 is either flat or generally concave, while upper bulb wall 106 is generally convex. In this embodiment of the invention, lower bulb wall 108 (the portion that is impacted by the tongue during a sucking action) and upper bulb wall 106 (the portion that rests on or near the palate) are increased in thickness to about 1.5 mm, thus making these portions stiffer. Also, wall 108 is adapted to have a convex shape, whereas typical pacifiers have a thin (about 1.0 mm) flat front/lower wall that collapses under the slightest force.

Bulb sides 109*a* and 109*b* remain at the typical 1.25 mm thickness, which makes them a bit weaker than lower and upper walls 108 and 106, respectively. As a result of the thicknesses and shapes, when region 108 is pushed generally upward by the tongue toward region 106, the force is distributed in a more outward direction rather then solely upward as in previous designs. This causes lateral expansion of bulb sides 109*a* and 109*b*. The lateral expansion is aided by the inclusion of one or more ribs 107 (three in this embodiment) on the inside of wall 106 that further stiffen the upper portion of this wall. The ends of ribs 107 follow generally the inward curve of sides 109*a* and 109*b* from distal end 111 toward neck 102, to generally demarcate the side regions 109*a* and 109*b* that expand outward due to tongue pressure. By altering the curvature and shape of upper region 106 such that it generally fits closely with the roof of the mouth, sides 109*a* and 109*b* press laterally against the alveolar ridge. The presence of ribbing confers rigidity to the ribbed region, causing redirection of forces laterally, resulting in lateral expansion of the bulb as force is applied to the front/lower wall 108 of the bulb resulting from sucking. The sides of the bulb are then pushed up and out against the palate upon application of force.

FIGS. 1-3 indicate sizes and radii of curvature in mm of certain aspects of size 3, 2 and 1 pacifiers/nipples, respectively, of this embodiment of the invention. In general, smaller sized pacifiers may have different sized and shaped bulbs to accommodate the underdeveloped oral physiology. Lower wall 108 has a generally spherical shape with a radius of curvature as small as 10.5 mm, or larger to increase convexity. In general, greater convexity of wall 108 will lead to greater lateral expansion potential for the bulb, but the thickness of wall 108 would have to be increased in order to prevent collapse of the wall as it is compressed by the tongue.

The curvature of wall 108 is also dependent on the radii of curvature of the areas surrounding wall 108. In the size 3 embodiment shown in FIG. 1, the lower radius of curvature ($R_A$, FIG. 1D) is about 5 mm, and the upper ($R_B$) is about 3 mm. As $R_A$ is increased and $R_B$ is decreased, the overall convexity of wall 108 will increase as well, and as $R_A$ is decreased and $R_B$ is increased the convexity of wall 108 will decrease. Variation could be as large as about 50% in radii of curvature at these locations from those described herein and depicted in the drawings of FIGS. 1-3. Ultimately, the shape of tongue pad 108 is described by a Bezier curve that connects the regions having radii $R_A$ and $R_B$.

Upper wall 106 is a flatted curve that matches or approximates the top palate, typically having a radius of curvature that is defined or influenced by that of distal portion 111, sides 109*a* and 109*b*, and $R_A$. The profile of wall 106 is not exactly a circular radius, but rather a lofted transition. Ribs 107 are integrally molded in nipple 100 and are about 2 mm wide and about 1 mm high. These ribs further increase the stiffness of the ribbed region of wall 106, which contributes to the expansion of regions 109*a* and 109*b*.

The radii of curvature that define the bulb shape are adjusted in order to optimize the expansion and displacement of the translated forces to achieve a desired result. The radii of curvature given are embodiments that result in a bulb shape that rests more ergonomically against the top palate, while positioning the tongue pad in such a way to optimize the contact region of the tongue. Wall thicknesses may vary as much as needed to provide the specific force redirection. The convex tongue pad region may be made more convex to accomplish greater expansion.

An orthodontic treatment embodiment of this appliance design could also incorporate lateral regions that have super-expansion potential. These regions may have a different material to provide for greater expansion (e.g., an elastomer), and/or a different construction, for example a collapsible bellows or other features described below.

Figure 4C:
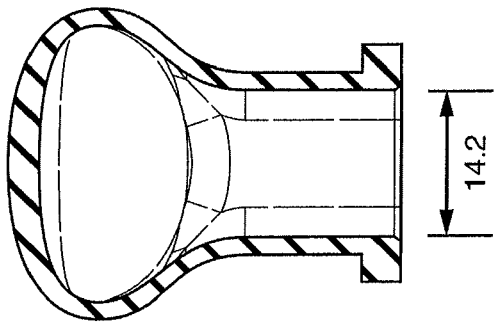
FIGS. 4A-4C are end, vertical cross-sectional, and horizontal cross-sectional views, respectively, of a second embodiment of the invention.
Figure 4B:
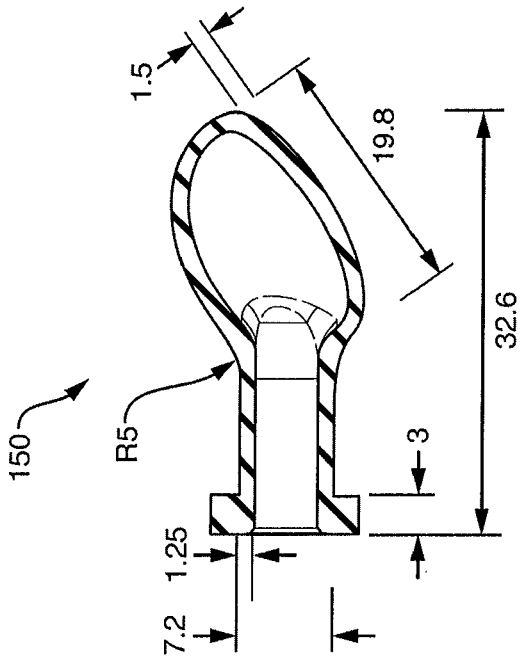
Figure 4A:
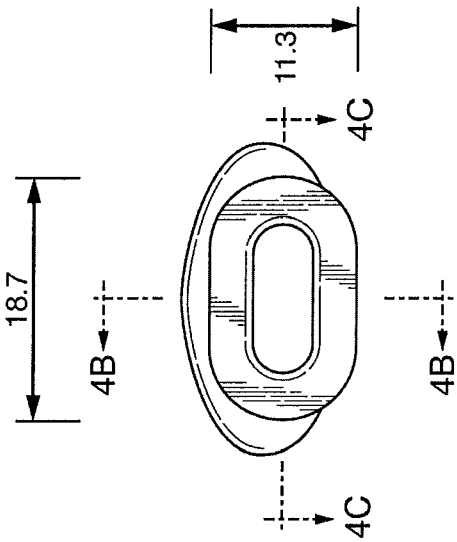
Figure 5C:
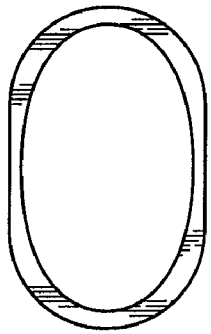
FIGS. 5A-5E are two end views, vertical cross-sectional, and horizontal cross-sectional views, respectively, of a third embodiment of the invention comprising a reversible/cherry shaped pacifier/nipple.
Figure 5B:
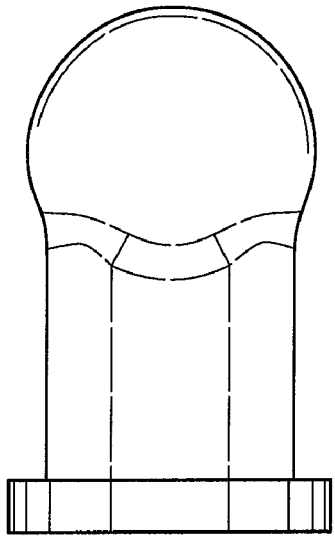
Figure 5A:
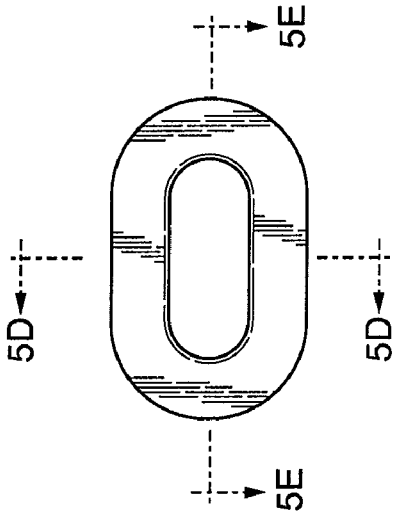
Figure 5E:
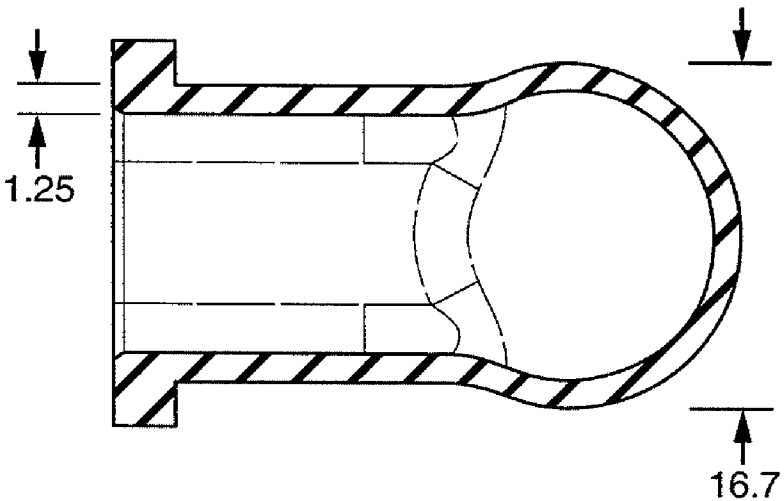
Figure 5D:
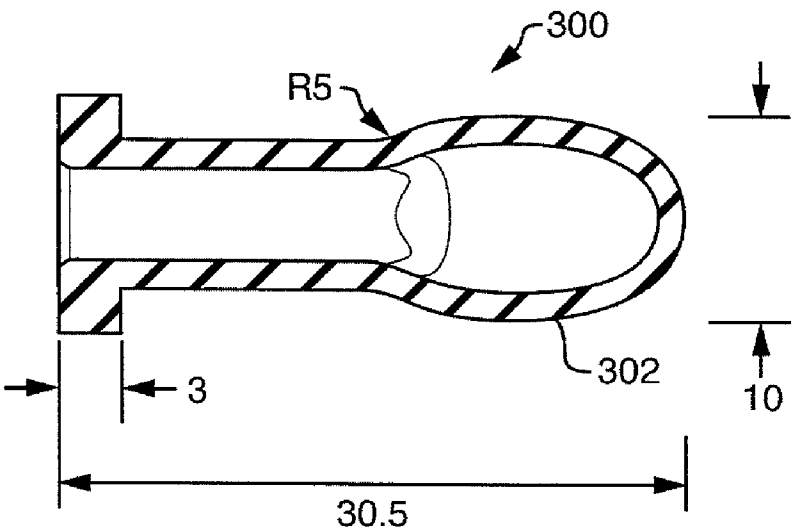

FIG. 4 details another embodiment 150 that is very much like those of FIGS. 1-3, but without internal ribbing. This embodiment relies on material thickness in the upper wall to provide the desired stiffness.

The region of the bulb that can contain the ribbing is not limited to the top and/or bottom areas. Ribbing may be added to the tongue pad region as well. Ribbing could be any thickness, and may spread throughout the entire bulb. Ribbing is used to stabilize the bulb and to direct forces, therefore it is not limited to any position. Position of ribs or position lacking ribs can change bulb distortion the same as varying the thickness or changing the materials. For example, areas may have thinner and more flexible material and could have ribbing for more support.

The pacifier/nipple can be constructed to deliver different forces (e.g. applying forces to particular locations in the mouth) by combining different features of the bulb adaptations as described herein, including, e.g., ribbing, variation in size, shape, and wall thickness and/or curvature. In some cases, what is desired is to design the appliance such that portions of the bulb push out against the palatal arch as the child sucks, while in other cases, what is desired is to design the appliance such that portions of the bulb push up and out against the arch as the child sucks. The magnitude of the forces may be determined and altered depending on the desired results.

As a prescribed device to treat certain symptoms, the ratio of expansion may be altered to accommodate the patient's needs. There will always be upward force due to intraoral pressure and tongue push. A particular mechanism, or combination thereof and materials can be chosen as described herein so as to achieve a desired result. The extent of force redirected can be designed to partially or fully counteract, or even exceed, suction-induced, inwardly-directed forces, to achieve a desired health benefit. For example, adaptations may be made to account for variable sucking pressure (force) applied in different age groups and/or particular individuals such that the force is counteracted according to the pressure applied. In another example, adaptations may be made wherein the extent of force distributed can be designed so as to exceed suction-induced forces in order to treat malocclusions which have begun to initiate in a child. Similarly, the locations of, and/or extent of expansion motion can be designed to achieve a desired result. Provided design factors allow the development of an appliance that can be used with a child of a particular age to ameliorate malocclusions, or to achieve a desired health benefit such as correction of an existing problem caused by the use of non-nutritive sucking (e.g., standard pacifiers, thumb, fingers, etc.). For example, children presenting with cross-bites and currently sucking pacifiers can be fitted with an appliance with an expanding bulb that directs greater force laterally, such as by modifying the embodiments of FIGS. 1-3 to engage the maxillary posterior teeth.

Mechanisms described herein may be adapted and altered using various sizes and shapes of nipple arrangements. Preferably, conventional nipple sizes and shapes utilized in the industry will be adapted for this purpose. As discussed above, the size of a nipple appliance, as well as integration of one or more expansion mechanism(s), may be adapted accordingly to provide the necessary appropriate force distribution for the child of a particular age and size, as desired.

Figure 6:
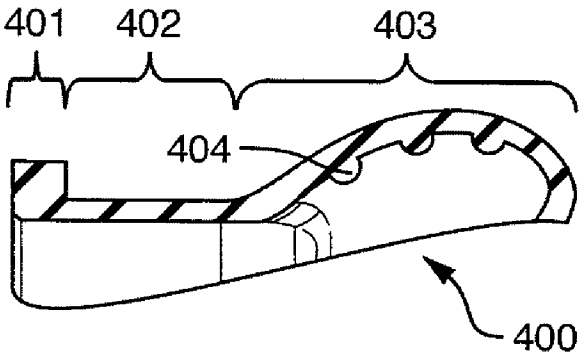
FIG. 6 is a partial cross-sectional view of another embodiment of the invention comprising a reversible/cherry shaped pacifier/nipple with ribs inside both the upper and lower sides of the bulb.

Additionally, integrated mechanisms provided herein are useful in any style/shape bulb, including the standard shape shown in FIGS. 1-4, a cherry/reversible (FIG. 5), or an oblate shaped bulb, and may be adapted accordingly. Other uses of the inventive appliance include the nipples on baby bottles and toddler sippy cups. Additionally, future pacifiers and nipples of different external shapes than those shown in the drawings would still be able to accept the integrated mechanism/design scheme of the invention. For example, an alternative construction that operates on the same mechanical principle as the embodiment of FIGS. 1-3, is shown in FIG. 5 (no ribbing) and FIG. 6 (with ribbing). Appliance 300, FIG. 5, comprises a cherry/reversible shaped bulb integrating the adaptations described for those above in FIGS. 1-4. In the present embodiment, bulb 302 (FIG. 5) and bulb 403 (FIG. 6) are constructed such that they can be expanded upward and outward against the arch in the area of the alveolar process. Increased wall thickness in the top and bottom walls (either by actually increasing wall thickness and/or adding ribbing 404 as shown in FIG. 6) and the height of the bulb provide mechanics resulting in a more lateral spread when force is applied to the front of the bulb upon sucking. As in the previously described designs, changes in wall thickness and curvature of the walls confer the benefit of force distribution and redirection.

Appliance 400, FIG. 6, comprises a ribbing pattern in bulb 403. However, in this embodiment, because the shape is reversible, the integrated ribbing 404 is included on both the top and bottom of bulb 403. For reference purposes, base 401 and neck 402 are also shown.

Figure 7:
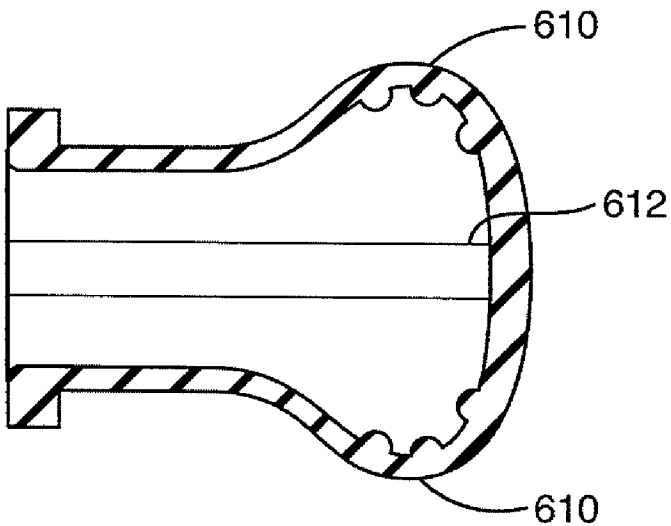
FIG. 7 is a schematic cross-sectional view of another embodiment of the invention comprising a reversible/cherry shaped nipple with ribs inside both the upper and the lower portions of the bulb, as well as comprising an open valve or channel to allow for feeding.

In still other embodiments, an appliance of the invention may be adapted for use as a feeding nipple. FIG. 7 depicts an exemplary schematic view of an adaptation of the embodiment of FIG. 6 as a feeding nipple. As in FIG. 6, the bulb in this example comprises ribbing 610 at both the top and bottom of the bulb, although this is not a limitation of the invention. In addition, open channel 612 is incorporated into the design to allow for passage of liquid. In alternate adaptations, a nipple may comprise a valve or hole at the tip of the bulb to allow for passage of liquid. Similar to pacifiers and teething devices, any particular shape or design may be adapted accordingly for use as a feeding nipple.

Figure 8B:
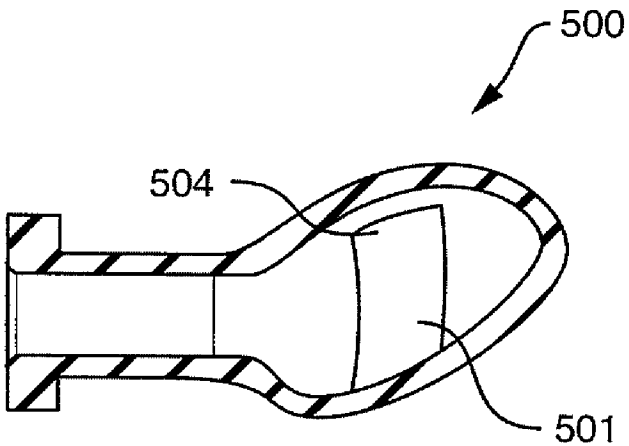
FIG. 8B is a cross-sectional view of the embodiment of FIG. 8A.
Figure 8A:
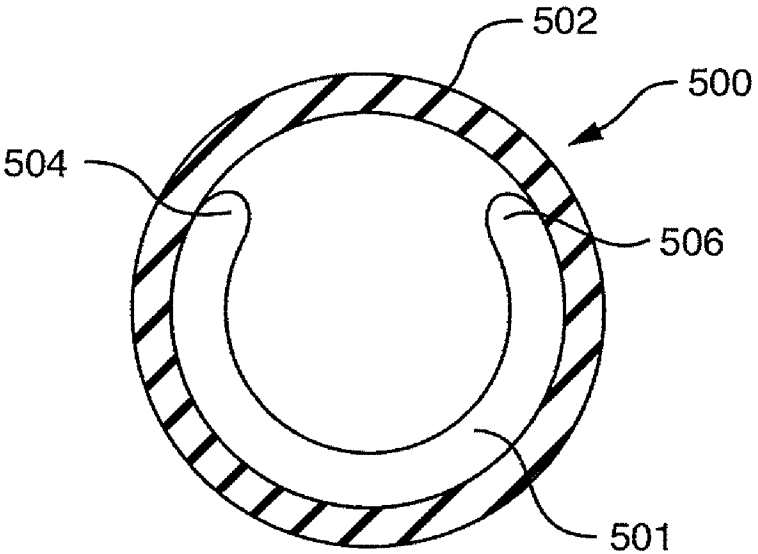
FIG. 8A is a schematic vertical cross-sectional view of another embodiment of the invention with a single integral rib.

Another embodiment contemplates a variation on the ribbing theme, and includes a mechanism that is substantially integrated into the bulb of the appliance. FIG. 8A depicts a front view and FIG. 8B a cross-sectional view of such a variation embodiment, 500. As shown in FIGS. 8A and 8B, a large rib 501 may be integrated into bulb 502. The rib may be wholly integrated, except perhaps at the tips 504, 506 at the upper end of the rib. In the regions where the rib is not integrated, a small space (e.g., about 1 mm) is left between the rib and the bulb wall, to allow for flexion in the desired direction (up and out, as in other embodiments). Although this mechanism is a larger rib as compared to other embodiments depicted herein, the mechanism, flex, and direction of force in the bulb functions similar to the other embodiments described herein.

Figure 9C:
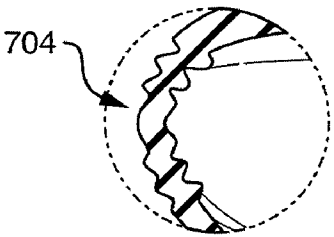
FIG. 9C is a partial cross-sectional view of the bulb wall after it has expanded.
Figure 9B:
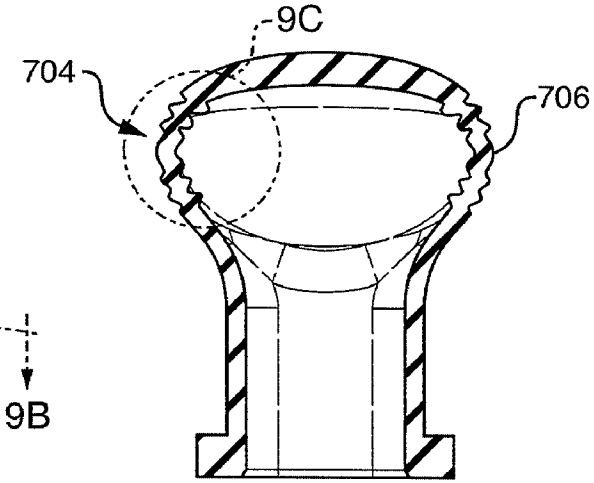
Figure 9A:
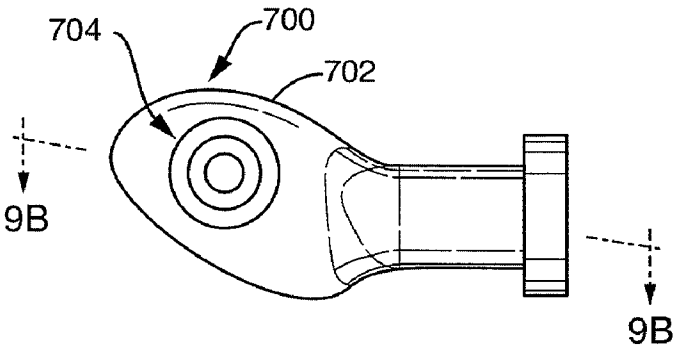

FIGS. 9A and 9B show another embodiment in which the sides of the bulb expand. FIG. 9A is a side view of bulb 700. FIG. 9B is a cross-sectional view taken along line A-A of FIG. 9A. Bulb 700 has a pleated, accordion-like section 704 and 706, one on each side of bulb 700. Sections 704 and 706 are designed to expand during a sucking action. Expansion in this case can be augmented by the increased fluid pressure within the sealed interior of bulb 700 as bulb 700 is compressed by the tongue. The wall weaknesses created by the concentric folds in areas 704 and 706, together with the excess material in the folds, causes areas 704 and 706 to balloon outward as shown in FIG. 9C as the bulb is compressed by the tongue. This same type of expansion action could be accomplished with different constructions, as described elsewhere. For example, a stretchier material could be located in areas 704 and 706 rather than the pleats, to create ballooning regions. The interior of the bulb could enclose a liquid or gel that could both assist in the expansion action, as well as allow the appliance to be cooled or even frozen to help with teething pain.

Figure 10B:
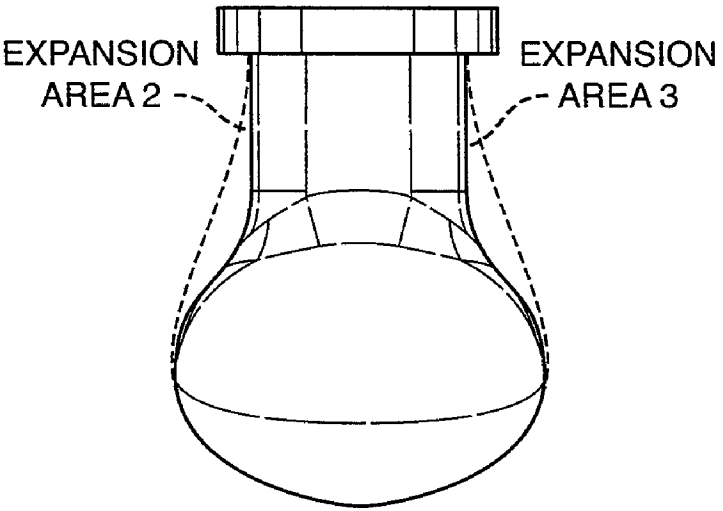
FIGS. 10A and 10B are schematic side and top views, respectively, illustrating the site of tongue force application to the inventive pacifier/nipple during a sucking action, and the resulting regions that expand following application of tongue force.
Figure 11:
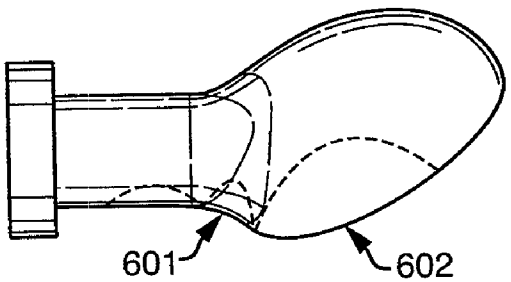
FIG. 11 is a schematic side view of an embodiment of the invention illustrating how the inventive appliance is deformed under tongue peristalsis.
Figure 10A:
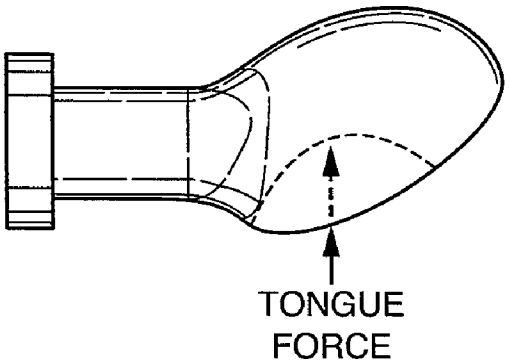

FIGS. 10A and 10B depict the compression and expansion of the inventive bulb, while FIG. 11 depicts how the bulb may be deformed under tongue peristalsis, wherein anterior portion 601 is first compressed, and then more posterior portion 602.

Materials used for production of embodiments of the invention may include a silicone or a latex which is approved for food contact and FDA applications. A material having a Shore A hardness of about 50 is currently used. In some embodiments, one or more material(s) used in construction of the inventive appliance is liquid injection mold (LIM) grade. In some embodiments, one or more materials used in construction of the inventive appliance is compression mold (CM) grade. Other materials could be used. Desirable characteristics include elasticity, shape memory, stiffness/hardness, etc.

Ribbing may be comprised of the same material as the rest of the appliance, or not. Different materials may be used, or different durometers of the same material, to achieve desired forces. Ribbing may be comprised of different synthetic materials to allow for greater or less elasticity or flex.

In some embodiments, the materials of the bulb are identical throughout its construction. In some embodiments, the materials may vary where ribbing is integrated (e.g., in the inside upper portion of the bulb). In other embodiments, the material of the bulb may differ from the material of the neck and/or base of the nipple, in whole or in part.

In some embodiments, a multi-material design comprising varied materials may be utilized in order to achieve variable shape, wall thicknesses, ribbing, and/or curvature, as desired, in order to achieve the desired results as described herein. For example, the base and neck may comprise a stiffer material than all or a portion of the bulb, so that the bulb has sufficient flexibility to expand in the desired manner. Additionally or alternatively, ribbing integrated in the bulb may optionally be comprised of the same stiffer material as the neck and/or base, or be comprised of the same material as the bulb. Alternatively, ribbing integrated into the bulb may be comprised of a distinct material.

The invention can be accomplished by changing the dimensions (radii of curvature, wall thicknesses, overall lengths) by as much as about +/−35% over the nipple designs described above. The effect of changing the wall thickness is to create a more flexible or a stronger, more force-directing section. Similarly, changing the radii of curvature will cause the bulb to be more prone to flex in a given direction (smaller radii of curvature) or not flex in a given direction (larger radii of curvature). Preferably, the difference in wall thickness and ribbing from one side (the reinforced region) to another (the strengthened region) should not exceed 50%. If this were to happen, theoretically, the bulb would be prone to collapsing on the thinner section rather then expanding.

Regarding the ribbing, the ribs shown in most of the drawings herein have an approximate radius of curvature of about 0.5-0.25 mm. The ribbing should begin to lose its effectiveness as ribbing when the ribbing radii reach a size greater or equal to about 2 mm: at this point the ribbing becomes less of a feature added to the bulb and more of a variation in wall thickness. It is believed that radii larger than 2 mm would not be affective in redirecting forces based on the fact that the volume of the ribbing would be equal or greater then the wall thickness of surrounding non-ribbed sections). The ribbing would not be effective when its diameter or length was greater than the surrounding non-ribbed areas. If this case were to happen, the ribbed feature would override the non-ribbed feature, causing an undesired flexure at that location. Additionally, as stated above, the ribbing at a size greater than the surrounding non-ribbed wall becomes less an internal feature and more of a wall thickness.

Shape memory materials that have one or more properties that can be altered in a controlled manor by external stimuli, such as stress, temperature, moisture, pH, or electric field, can be useful to achieve a desired shape change (expansion). One potential material is Nitinol. By embedding Nitinol wires of about 0.020" diameter or smaller into the bulb, a temperature-sensitive reaction or stress (force) sensitive reaction that aids the expansion could be accomplished. Additionally embedding a shape-memory textile or polymer (examples include polyurethanes or polyethylenes) would allow for much more precise stress or temperature sensitive motions. Optimal use would be to embed these materials into the bulb or in some cases actually make the bulb out of the given material. Additional materials would be a silicone (current prototypes are a 50 A Shore silicone) or a 50 A Shore latex. Durometers of these materials should ideally be about 35-65 Shore A. Values lower then 35 would be too "gummy" and would not be able to hold shape, even with the aid of embedded shape memory materials. Similarly, Shores harder then 65 would result in a bulb too rigid to flex appropriately. Ribbing material may differ in Shore, or in the actual material, but should fall within the range defined above. Additionally, a multi-Shore bulb would require the durometers to be within the given range in order to function properly. A variation of Shore hardness great than 30 may create a failure of the designed area of collapse.

The inventive appliances may be adapted for use and/or incorporated into a baby product for use. For example, the appliances are useful as pacifiers and may be adapted by addition of a shield fixed to the base portion, and an optional handle attached thereto. Additionally and/or alternatively, the appliances are useful in teething devices. Similar to a pacifier, a shield and/or additional material may be affixed to the base portion for a teething device. Additionally, a nipple of a teething device and/or a pacifier may be filled with a liquid, gas, or gel. In some embodiments, a teething device or pacifier comprising a nipple appliance of the invention may be subjected to freezing. Any particular embodiment of the provided nipple appliance, including various shapes (e.g., normal, cherry/reversible, oblate, etc.) may be adapted for use incorporated into a baby product, as preferred. In particular, any of the conventional shapes of pacifiers or teething devices (e.g., normal, cherry/reversible, oblate, etc.) may be adapted by the provided mechanisms for pacifier and/or teething device use.

In addition to conventionally known products in which the inventive appliances are useful, additional modified products are presently used, wherein incorporation of the present appliance may be useful. For example, pacifiers and nipples having external adaptations are known and used in the industry. Thus, the appliances of the present invention may be adapted with additional external modifications including, e.g. an anti-tongue coating neck, an anti-pout lip neck, and/or external teething texture.

Any patent and scientific literature referred to herein establishes knowledge available to those of skill in the art. The issued patents, applications, and references cited herein are hereby incorporated by reference in their entirety to the same extent as if each was specifically and individually indicated to be incorporated by reference.

While the foregoing invention has been described in some detail for purposes of clarity and understanding, particular embodiments are to be considered as illustrative and not restrictive. It will be appreciated by one skilled in the art from a reading of this disclosure that certain changes in form or detail may be made without departing from the scope of the invention and are within the scope of the following claims. For example, features shown in some drawings and not others may be combined in different manners in accordance with the invention.

What is claimed is:

1. An intraoral orthodontic appliance, comprising:

a base portion;

a single-lobed bulb portion for insertion into the mouth of a child; and a neck portion connecting the base portion to the bulb portion;

wherein the bulb portion is hollow and at least substantially closed at its distal end farthest from the neck portion, the bulb portion defining a lower wall that is adapted to be contacted by the tongue when the bulb is located in the mouth and the child sucks on the bulb, an upper wall opposite the lower wall, the upper wall adapted to contact the top of the palate when the child sucks on the bulb, and side regions that are located along the sides of the bulb and span the distance between the lower wall and the upper wall;

wherein the lower wall, the upper wall and the side regions are each convex;

wherein the upper wall is stiffer than the lower wall;

wherein the bulb portion further comprises a plurality of spaced elongated ribs that are transverse to a plane that bisects the upper and lower walls and that are integrated into and on the inside surface of the upper wall;

wherein the upper and lower walls are both stiffer than the side regions; and wherein at least partially as a result of the ribs, and the shapes and relative stiffnesses of the upper and lower walls and the side regions, when the lower wall is pushed generally upward by the tongue during a sucking action the side regions expand outward to cause lateral pressure against the palate, the alveolar ridge, and/or the teeth.

2. The appliance of claim 1 wherein the side regions of the bulb are constructed of at least one different durometer material as compared to the upper and lower walls of the bulb.

3. The appliance of claim 1 wherein the bulb has a traditional shape.

4. The appliance of claim 1 wherein the bulb is oblate shaped.

5. The appliance of claim 1 wherein the bulb is cherry shaped.

6. The appliance of claim 1 further comprising a shield.

7. The appliance of claim 6 which is adapted for use as a teething device.

8. The appliance of claim 7, wherein the bulb is filled with a liquid or gel.

9. The appliance of claim 8, wherein the appliance can be frozen before use.

10. The appliance of claim 6 which is adapted for use as a pacifier.

11. The appliance of claim 1 which is adapted for use as a feeding nipple.

12. The appliance of claim 11 wherein the appliance further comprises an open channel for passage of liquid.

13. The appliance of claim 11 wherein the appliance further comprises a valve or hole to allow passage of a liquid.

14. A baby product comprising the appliance of claim 1, wherein the product is selected from a bottle nipple, a bottle, a pacifier, a teething device and a feeding device.

15. The appliance of claim 1, further comprising one or more external adaptations of the appliance selected from the group of adaptations consisting of an anti-tongue coating neck, an anti-pout lip neck, and external teething texture.

16. The appliance of claim 1 wherein at least the upper wall of the bulb is symmetric about the plane that bisects the upper and lower walls of the bulb portion, and the ribs are orthogonal to the plane.

17. The appliance of claim 16 wherein the ribs define a radius of curvature of no more than 2 mm.

18. The appliance of claim 1 wherein the area of the bulb wall that is ribbed is no greater than the area of the bulb wall that is not ribbed.

19. The appliance of claim 1 further comprising a single lower rib spanning the entire lower wall and at least a part of both of the side regions.

20. The appliance of claim 19 the single rib defines ends that are spaced from the bulb wall.

21. The appliance of claim 1 comprising ribs on the inside surface of the upper wall and the lower wall but not the side regions.

22. The appliance of claim 1 wherein at least some of the ribs are of a different material than the bulb walls.

23. The appliance of claim 1 wherein the bulb is made of one material.

24. The appliance of claim 23 wherein the material has a durometer of about 35-65 Shore A.

25. The appliance of claim 23 wherein the lower and upper walls have a thickness of about 1.5 mm.

26. The appliance of claim 25 wherein the side regions have a thickness of about 1.25 mm.

27. The appliance of claim 1 wherein the radius of curvature of the upper wall is about 3 mm and the radius of curvature of the lower wall is about 5 mm.

28. The appliance of claim 1 wherein the radius of curvature of the lower wall is about 4 mm.

29. The appliance of claim 1 wherein the radius of curvature of the lower wall is about 3.5 mm.

30. The appliance of claim 1 wherein the bulb defines a series of concentric folds in each of the side regions.

31. The appliance of claim 1 wherein the side regions are made from a different material than the rest of the bulb.

32. The appliance of claim 31 wherein the different material is an elastomer.

33. The appliance of claim 1 wherein at least one of the upper and lower walls comprises an integrated structure that contributes to the wall stiffness.

34. The appliance of claim 33 wherein the integrated structure is made from a shape memory material.

35. An intraoral orthodontic appliance, comprising:

a base portion;

a single-lobed bulb portion for insertion into the mouth of a child; and a neck portion connecting the base portion to the bulb portion;

wherein the bulb portion is hollow and closed at its distal end farthest from the neck portion, the bulb portion defining a lower wall that is adapted to be contacted by the tongue when the bulb is located in the mouth and the child sucks on the bulb, an upper wall opposite the lower wall, the upper wall adapted to contact the top of the palate when the child sucks on the bulb, and side regions that are located along the sides of the bulb and span the distance between the lower wall and the upper wall;

wherein the lower wall, the upper wall and the side regions are each convex;

wherein the upper wall is stiffer than the lower wall;

wherein the upper and lower walls are both stiffer than the side regions;

further comprising a plurality of spaced, parallel ribs on the inside surface of and integrated into the upper wall of the bulb, wherein at least the upper wall of the bulb is symmetric about a plane that bisects the upper and lower walls, and the ribs are orthogonal to the plane, wherein the ribs define a radius of curvature of no more than 2 mm, and wherein the area of the bulb upper wall that is ribbed is no greater than the area of the bulb upper wall that is not ribbed;

wherein the bulb is made of one material that has a durometer of about 35-65 Shore A, wherein the lower and upper walls have a thickness of about 1.5 mm and the side regions have a thickness of about 1.25 mm; and wherein at least partially as a result of the ribs, and the shapes and relative stiffnesses of the upper and lower walls and the side regions, when the lower wall is pushed generally upward by the tongue during a sucking action the side regions expand outward to cause lateral pressure against the palate, the alveolar ridge, and/or the teeth.

* * * * *